US006293654B1

(12) United States Patent
Pidwerbecki

(10) Patent No.: US 6,293,654 B1
(45) Date of Patent: Sep. 25, 2001

(54) PRINTHEAD APPARATUS

(75) Inventor: David Pidwerbecki, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/064,571

(22) Filed: Apr. 22, 1998

(51) Int. Cl.[7] ..... B41J 2/05
(52) U.S. Cl. ..... 347/64
(58) Field of Search ..... 347/63, 62, 64

(56) References Cited

U.S. PATENT DOCUMENTS

| | | | | |
|---|---|---|---|---|
| 4,339,762 | | 7/1982 | Shirato | 347/62 |
| 4,354,309 | * | 10/1982 | Gardiner et al. | 29/571 |
| 4,513,298 | * | 4/1985 | Scheu | 374/64 |
| 4,535,343 | | 8/1985 | Wright et al. | 347/64 |
| 4,616,408 | | 10/1986 | Lloyd | 29/611 |
| 4,872,028 | | 10/1989 | Lloyd | 347/14 |
| 4,931,813 | | 6/1990 | Pan et al. | 347/62 |
| 4,951,063 | | 8/1990 | Hawkins et al. | 347/62 |
| 4,982,199 | | 1/1991 | Dunn | 347/15 |
| 5,083,137 | | 1/1992 | Badyal et al. | 347/14 |
| 5,168,284 | | 12/1992 | Yeung | 347/17 |
| 5,187,500 | | 2/1993 | Bohorquez et al. | 347/57 |
| 5,194,877 | * | 3/1993 | Lam et al. | 347/63 |
| 5,227,812 | * | 7/1993 | Watanabe et al. | 347/50 |
| 5,257,042 | | 10/1993 | Buhler | 347/64 |
| 5,357,081 | | 10/1994 | Bohorquez | 219/497 |
| 5,530,465 | | 6/1996 | Hasegawa et al. | 347/70 |
| 5,636,441 | | 6/1997 | Meyer et al. | 29/890.1 |
| 5,660,739 | | 8/1997 | Ozaki et al. | 216/27 |
| 5,682,188 | | 10/1997 | Meyer et al. | 347/61 |
| 5,883,650 | * | 3/1999 | Figueredo et al. | 347/62 |
| 6,007,188 | * | 12/1999 | MacLeod et al. | 347/65 |
| 6,042,221 | | 3/2000 | Komuro | 347/62 |
| 6,070,969 | | 6/2000 | Buonanno | 347/64 |

FOREIGN PATENT DOCUMENTS

| | | | |
|---|---|---|---|
| 0729834A2 | 3/1996 | (EP) | B41J/2/05 |
| 0750990A2 | 6/1996 | (EP) | B41J/2/14 |
| 0825026A2 | 8/1997 | (EP) | B41J/2/16 |
| 0794057 A | 9/1997 | (EP) | B41J/2/16 |
| 0816089A2 | of 1998 | (EP) | B41J/2/14 |
| 0887186A1 | of 1998 | (EP) | B41J/2/125 |
| 7-276639 | of 1995 | (JP) | B41J/3/04 |

OTHER PUBLICATIONS

E.V. Bhaskar, J.s. Sden; "Development of the Thin–Film Structure for the ThinkJet Printhead"; Hewlett–Packard Journal; May 1985, pp. 27–33.

R.A. Askeland, W.D. Childers, W.R. Sperry; "The Second–Generation Thermal Ink Jet Structure"; Hewlett–Packard Journal; Aug. 1988; pp. 28–31.

J.S. Aden, et al.; "The Third–Generation HP Thermal InkJet Printhead"; Hewlett–Packard Journal; Feb. 1994; pp. 41–45.

* cited by examiner

*Primary Examiner*—John Barlow
*Assistant Examiner*—Michael Brooke

(57) ABSTRACT

An ink jet print head apparatus having a reduced thickness passivation layer. Passivation layer thickness is preferably below 7000 angstroms to permit operation at a lower turn-on-energy. The passivation layer is preferably formed in a discrete manner and may include a nitride layer and a SiC layer. Various other layer arrangements are also described including the provision of a cavitation layer over the passivation layer. A thermal or other type of ink expulsion mechanism may be utilized.

20 Claims, 2 Drawing Sheets

PRINTHEAD APPARATUS

CROSS REFERENCE TO RELATED APPLICATIONS

The present application is related to U.S. patent application Ser. No. 08/920,478, entitled REDUCED SIZE PRINTHEAD FOR AN INKJET PRINTER, filed on Aug. 29, 1997, in the names of David Pidwerbecki, et al. This related application is commonly assigned to the assignee of the present application and is hereby incorporated by reference as if fully set forth herein.

FIELD OF THE INVENTION

The present invention relates to ink jet printers and, more specifically, to reducing the volume of ink drops expelled from an inkjet print head.

BACKGROUND OF THE INVENTION

Several types of ink jet printers are known in the art and they include those made by Epson, Canon and Hewlett-Packard, amongst others. To improve image quality, ink jet makers have continually tried to increase the number of ink dots that are ejected by the print head per unit area (usually square inch), for example, moving from 300 to 600 dots per square inch (dpi). This is achieved in part by reducing the size of each individual dot which in turn is achieved by reducing the volume of ink used to form each dot. An ink jet print head generally includes a firing chamber or well (hereinafter referred to as "well") that is fed by capillary action and bordered by a cover plate having an ejection orifice therein. An ink drop expulsion mechanism such as a heating element in a thermal ink jet printer or a piezo-electronic actuator in a mechanical ink jet printer is located adjacent the well. When it is desired to expel an ink drop from the well, the expulsion mechanism is excited causing an ink drop to be expelled through the ejection orifice.

Prior art attempts to reduce drop volume have included reducing well volume. If the well volume is reduced and the cover plate thickness remains the same, then the relative distance an ink drop must travel before being expelled is increased. This increased distance necessitates additional energy (increased heat or mechanical pressure, etc.), thus creating print heads that are disadvantageously energy consumptive and suffer reduced reliability because of stresses associated with increased operating temperature or additional mechanical pressure, etc. Higher operating temperatures may also affect print quality.

To reduce the distance an ink drop must travel before expulsion (and to reduce the requisite energy associated therewith) attempts have been made to reduce the thickness of the cover plate. Ths thickness, however, cannot be reduced in scale with other components due to physical limitations of the cover plate thickness. For example, in some commercially available units cover plate thickness has already been reduced to 45 $\mu$m which is approximately ⅓ the thickness of a human hair. It is difficult to reduce the cover plate thickness using conventional techniques substantially more than this and maintain structural integrity.

A need thus exists for a reduced well volume (drop volume) ink jet print head that does not require significantly increased expulsion energy and achieves this result in a manner substantially independent of cover plate thickness.

SUMMARY OF THE INVENTION

In the present invention, an ink jet print head apparatus includes a barrier layer formed on a substrate that defines an ink well. The apparatus further include an ink expulsion mechanism formed between said substrate and said ink. well, and an electrical passivation layer formed between said ink well and said expulsion mechanism that has a thickness of less than 7000 angstroms and that includes at least a nitride layer and a SiC layer.

The attainment of the foregoing and related advantages and features of the invention should be more readily apparent to those skilled in the art, after review of the following more detailed description of the invention taken together with the drawings.

DETAILED DESCRIPTION

In the description that follows, an embodiment of the present invention is described in the context of a thermal ink jet printer. It should be recognized that the teachings of the present invention, particularly those related to reducing the barrier between the expulsion mechanism and the ink well, can be applied to ink jet printers that utilize other expulsion mechanisms, such as mechanical/piezo-electric mechanisms, etc.

Figure 1:
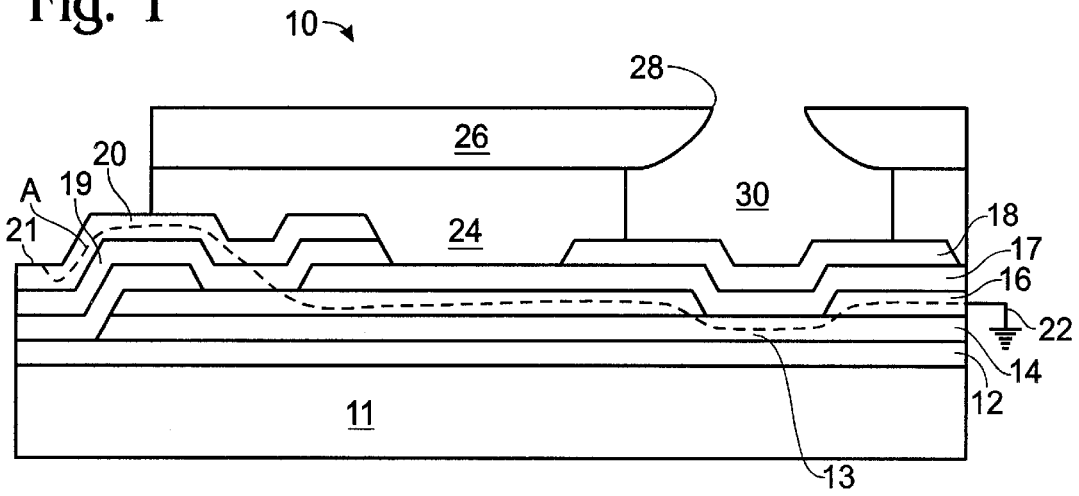
FIG. 1 is a cross-sectional view of a thermal embodiment of an ink jet print head structure in accordance with the present invention.

Referring to FIG. 1, a cross-sectional view of a thermal embodiment of an ink jet print head structure 10 in accordance with the present invention is shown. Structure 10 includes a substrate 11 preferably of semiconductor or ceramic material on which is formed a substrate thermal passivation layer 12. A resistive layer 14 is formed on the substrate (or the thermal passivation layer) and a conductive layer 16 is preferably formed on the resistive layer. An electrical passivation layer 17, is formed on the conductive and resistive layers 14,16 as shown and first and second cavitation layer portions 18,19 are preferably formed on the electrical passivation layer and the conductive layer, respectively. A second conductive layer 20 that includes a contact pad 21 is preferably formed on second cavitation layer portion 19.

In operation, an excitation signal is delivered to contact pad 21 and propagated through second conductive layer 20, second cavitation layer portion 19, conductive layer 16, a portion (hereinafter referred to as "resistor 13") of resistive layer 14 and back through conductive layer 16 to ground 22. Dashed line A indicates the path of the excitation current through structure 10. The passing of current through resistor 13 results in the production of heat which propagates through electrical passivation layer 17 and cavitation layer portion 18 to heat ink in well 30. Well 30 is defined by cavitation layer portion 18, ink barrier 24, cover plate 26 and the configuration of orifice 28. Ink in well 30 is heated until it bubbles in such a manner as to cause a volume of ink (an ink drop) to be expelled.

Referring more specifically to structure 10, if the substrate in a preferred embodiment is silicon then the substrate thermal passivation layer is preferably SiO2. Resistive layer 14 is preferably formed of tantalum aluminum (TaAl) or a substance having similar characteristics. The conductive layers 16 and 20 are preferably aluminum (Al) and gold (Au), respectively, or another conductive material that is suitable for the associated thermal and mechanical stresses. Electrical passivation layer 17 is preferably formed of a layer of silicon nitride (SiN) on which is formed a layer of silicon carbide (SiC). The SiN provides electrical isolation of the ink from the resistor. The SiC protects the conductive and resistive traces from liquid corrosion caused by the ink. In a preferred embodiment, the SiN is approximately ⅔ this the thickness of the electrical passivation layer and the SiC is approximately one third of this layer. For example, electrical passivation layer 17 with a thickness of 3000 Angstrom preferably has approximately 2000 Angstroms of SiN and 1000 Angstrom of SiC. Cavitation layer portion 18 protects layer 17 against cavitation damage and has been shown empirically with larger drop volumes (>50 ng dry weight at steady state) to enhance print quality. Suitable material for cavitation layer portions 18,19 is tantalum or the like and the formation of these layer portions is known in the art. The ink barrier is a material such as dried photoresist or the like that.defines well height and permits the formation of capillary channels as in known. The cover or orifice plate 26 is preferably electroplated nickel or the like. A suitable thin cover plate is also described in U.S. patent application Ser. No. 08/920,478, entitled Reduced Size Printhead for an InkJet Printer, which is owned by the assignee of the present application and is hereby incorporated by reference. While the electrical passivation layer 17 and cavitation layer portion 18 are discussed in more detail below, representative preferred dimensions of some of the components of structure 10 are as follows: orifice 28 diameter (18$\mu$m), orifice plate 26 thickness (28.5 $\mu$m), ink barrier 24 thickness (14 $\mu$m) and resistor 13 width (22 $\mu$m). These dimensions are provided for pedagogical reasons and are in no manner intended to limit the present invention.

Amongst other aspects, the present invention includes modifying the thickness of the electrical passivation layer to decrease the amount of energy required to expel an ink drop. In contrast to prior art attempts to reduce drop volume that have focused on reducing orifice plate thickness (a non-photolithographically formed layer), the present invention modifies photolithographically formed layers to achieve its desired end.

Figure 2:
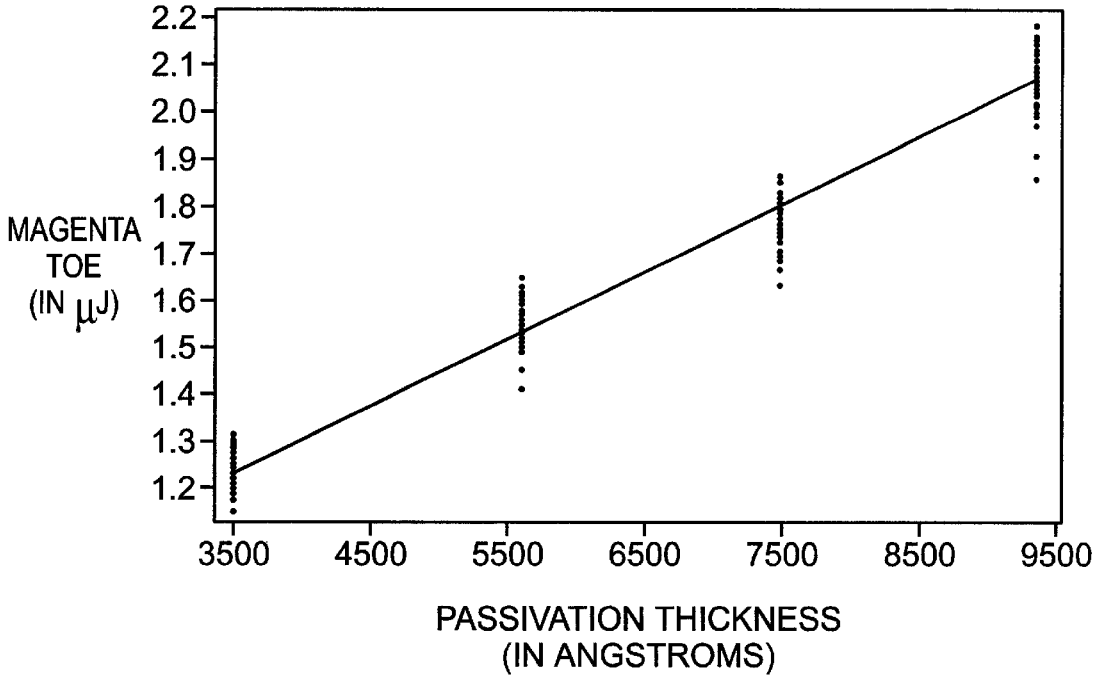
FIG. 2 is a graph of the electrical passivation layer thickness (for magenta color ink) versus the turn-on energy (TOE) in accordance with the present invention

Referring to FIG. 2, a graph of electrical passivation layer 17 thickness (for magenta color ink) versus ate turn-on energy (TOE) in accordance with the present invention is shown. A plurality of data points and and a regression line are shown. The turn-on energy is the energy required to expel an ink drop of predefined size (volume 1) and a preferred drop size is 10 ng (dry weight at steady state). The turn-on energy is measured by instrumentation. A relationship of TOE to the energy delivered to a print head and relative print head temperature drop mass is $TOE=mC_p\Delta T$ where m=mass of ejected drop, $C_p$=specific heat (constant pressure) of the ink and $\Delta T$=steady state temperature to which the print head is heated for high density printing. A graph specific to ink of the color magenta is provided because ink of different color has slightly. different TOE.

Conventionally, electrical passivation layers have not been made of thicknesses less than 750 nm. The graph of FIG. 2 indicates that by reducing the electrical passivation layer thickness, the TOE and correspondingly the heat to which resistor 13 must be heated are reduced. For example, a 25% reduction in passivation layer 17 thickness from 750 nm to 560 nm results in a 17% drop in TOE (from 1.8 $\mu$J to 1.5 $\mu$J).

Figure 3:
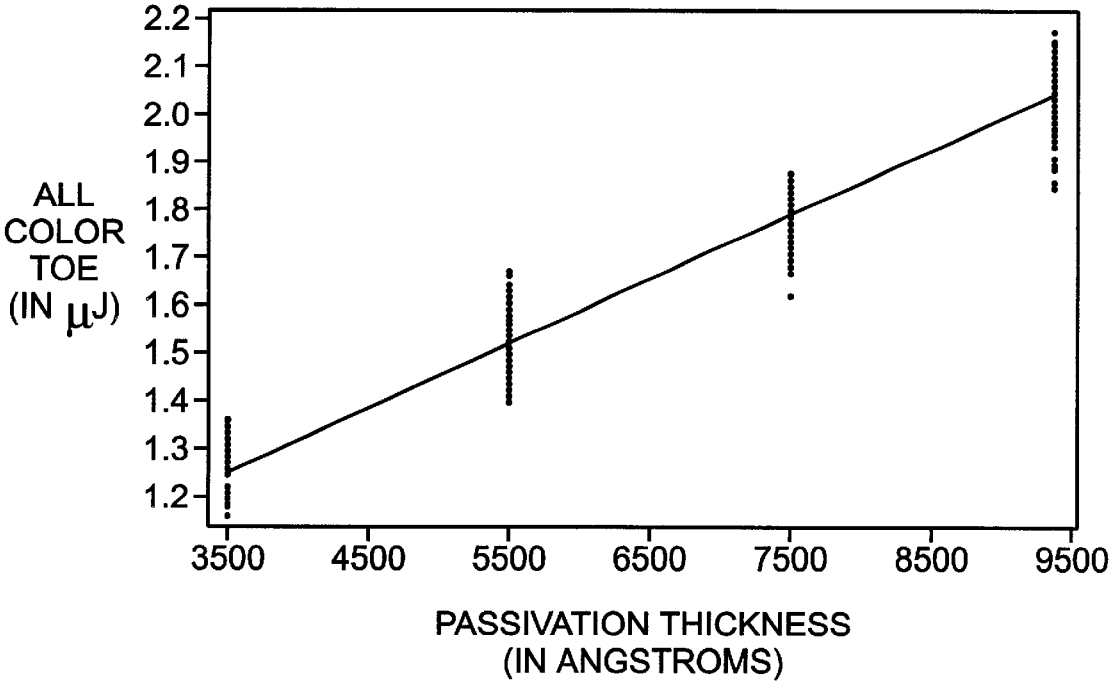
FIG. 3 is a graph of the electrical passivation layer thickness (for all color ink) versus the turn-on energy (TOE) in accordance with the present invention.

Referring to FIG. 3, a graph of electrical passivation layer 17 thickness (for all ink colors—magenta, cyan and yellow) versus the turn-on energy (TOE) in accordance with the present invention is shown. Data points and a regression line are provided. This graph further illustrates that a reduction in electrical passivation layer thickness results in a reduction of the turn-on energy.

Figure 4:
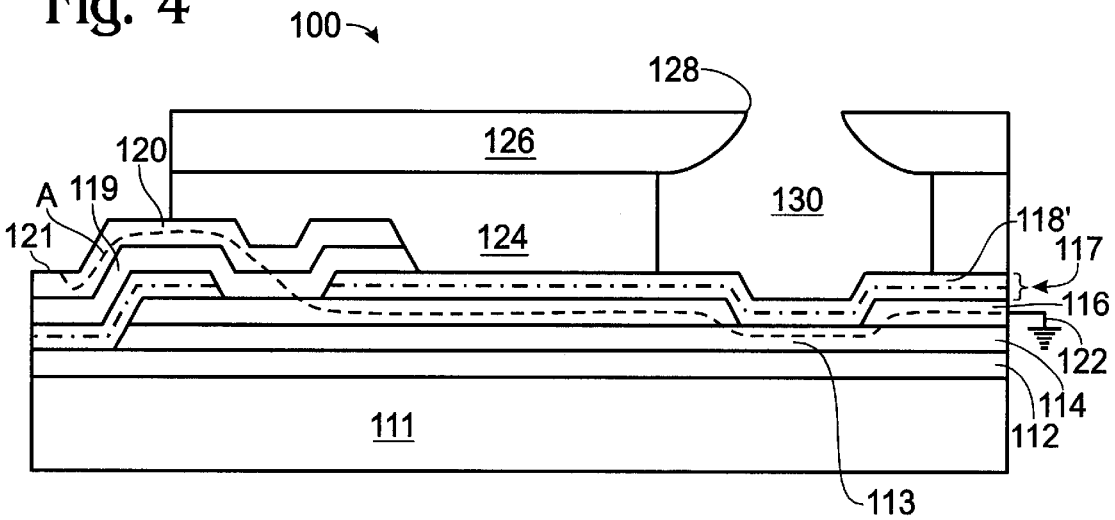
FIG. 4 is a cross-sectional view of an alternative embodiment of a low volume thermal ink jet print head structure in accordance with the present invention.

Referring to FIG. 4, other embodiments of a low volume thermal ink jet print head structure 100 in accordance with the present invention are shown and discussed. The structure of FIG. 4 is analogous to the structure shown in FIG. 1 and like components have had a one (1) added in the hundreds' digit.

As ink drop volume is reduced, the cavitation damage caused by bubbling ink is reduced. Recognizing this phenomenon permits the formation of several alternative embodiments in which the cavitation layer 18 (FIG. 1) is reduced or eliminated and the electrical passivation layer 17 (FIG. 1) is potentially further reduced. In one embodiment, cavitation layer portion 18 (of FIG. 1) has been removed. In this case, passivation layer 117 defines the bottom of the ink well and if a SiN/SiC passivation layer is utilized, then the SiC defines the well bottom (i.e., the ink contact surface). In another embodiment, cavitation layer 18 (FIG. 1) or the like is combined with or used in place of the portion of passivation layer 17 (discussed above): that protected against liquid corrosion, e.g., the SiC layer. This achieves a passivation layer 117 comprised of an electrical isolation layer, preferably SiN, and a conductive corrosion protection layer 118' that may include tantalum or a like metal, SiC or the like, or a combination of these or like materials.

While the present invention has been described in the context of a thermal ink jet printer, it should be recognized that its teachings are applicable to other ink jet printers. For example, if resistor 13,113 is replaced with a piezo-electric actuator 13,113, reducing passivation layer 17,117 and/or reducing or eliminating the cavitation layer would result in a more direct transfer of mechanical energy from the actuator to the ink drop.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. An ink jet print head apparatus, comprising:

a substrate;

an ink expulsion clement formed on said substrate;

a discrete passivation layer formed over said ink expulsion element;

a discrete cavitation layer formed over said passivation layer; and a barrier formed over said cavitation layer that defines an ink well;

wherein said discrete passivation layer has a thickness of less than 7000 Å, wherein said passivation layer includes a SiC layer and a nitride layer, said SiC layer being formed over said nitride layer.

2. The apparatus of claim 1, wherein said nitride layer includes SiN.

3. The apparatus of claim 1, wherein said expulsion mechanism includes a heat source.

4. The apparatus of claim 3, wherein said heat source includes a resistor, and current is delivered to said resistor via a conductor formed at least in part of aluminum.

5. The apparatus of claim 1, wherein said discrete passivation layer has a thickness of less than 5500 Å.

6. The apparatus of claim 1, wherein said cavitation layer is formed directly on said passivation layer.

7. The apparatus of claim 1, wherein said discrete passivation layer has a thickness of less than 4000 Å.

8. The apparatus of claim 1, in which the requisite turn on energy for a drop of approximately 10 ng (dry weight steady state) is approximately 1.7 $\mu$J or less.

9. The apparatus of claim 1, wherein said expulsion mechanism includes a piezo-electric actuator.

10. The apparatus of claim 1, wherein said discrete passivation layer has a thickness of approximately 6500 Å or less.

11. A thermal inkjet print head apparatus, comprising:

a substrate;

a barrier layer formed on said substrate that defines an ink well;

an ink expulsion mechanism formed between said substrate and said ink well; and an electrical passivation layer formed between said ink well and said expulsion mechanism that has a thickness of less than 7000 angstroms and that includes at least a nitride layer and a SiC layer.

12. The apparatus of claim 11, wherein said nitride layer includes SiN.

13. The apparatus of claim 12, wherein said passivation layer has a thickness of less than 5500 Å.

14. The apparatus of claim 11, wherein said ink expulsion mechanism includes a resistor to which current is delivered via a conductor containing, at least in part, aluminum; and wherein said nitride layer is formed over said aluminum containing conductor.

15. The apparatus of claim 11, further comprising a cavitation layer formed between said passivation layer and said ink well that protects against cavitation damage from ink in said ink well.

16. The apparatus of claim 15, wherein said cavitation layer is formed directly on said passivation layer.

17. The apparatus of claim 11, wherein said ink well is formed directly on said electrical passivation layer.

18. The apparatus of claim 11, wherein said nitride layer is formed under said SiC layer.

19. The apparatus of claim 11, wherein said passivation layer is formed in a discrete manner.

20. The apparatus of claim 11, wherein said discrete passivation layer has a thickness of approximately 6500 Å or less.

* * * * *

UNITED STATES PATENT AND TRADEMARK OFFICE

CERTIFICATE OF CORRECTION

PATENT NO. : 6,293,654 B1
DATED : September 25, 2001
INVENTOR(S) : David Pidwerbecki It is certified that error appears in the above-identified patent and that said Letters Patent is hereby corrected as shown below:

Column 4,
Line 54, “clement” should read -- element --.

Signed and Sealed this

Eighteenth Day of February, 2003

JAMES E. ROGAN
*Director of the United States Patent and Trademark Office*